US010380985B2

(12) United States Patent
Taniguchi et al.

(10) Patent No.: US 10,380,985 B2
(45) Date of Patent: Aug. 13, 2019

(54) KEYBOARD DEVICE

(71) Applicant: CASIO COMPUTER CO., LTD., Shibuya-shi, Tokyo (JP)

(72) Inventors: Hirokazu Taniguchi, Tachikawa (JP); Toshiya Kuno, Hamura (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/033,015

(22) Filed: Jul. 11, 2018

(65) Prior Publication Data

US 2019/0019484 A1 Jan. 17, 2019

(30) Foreign Application Priority Data

Jul. 12, 2017 (JP) ..... 2017-135896

(51) Int. Cl.

| | |
|---|---|
| ***G10C 3/12*** | (2006.01) |
| ***G10H 1/34*** | (2006.01) |
| ***G10C 3/16*** | (2019.01) |
| *G10C 3/18* | (2006.01) |

(52) U.S. Cl.

CPC ..... *G10H 1/346* (2013.01); *G10C 3/12* (2013.01); *G10C 3/16* (2013.01); *G10C 3/18* (2013.01)

(58) Field of Classification Search

CPC ..... G10C 3/04; G10C 3/12

See application file for complete search history.

(56) References Cited

U.S. PATENT DOCUMENTS

| | | | | | |
|---|---|---|---|---|---|
| 476,766 | A | * | 6/1892 | Kringel | G10C 3/12 84/440 |
| 3,903,780 | A | * | 9/1975 | Aliprandi | G10C 3/12 84/433 |
| 4,217,803 | A | * | 8/1980 | Dodds | G10H 1/346 200/277 |
| 4,667,563 | A | * | 5/1987 | Wakuda | G10H 1/344 84/433 |
| 4,860,630 | A | * | 8/1989 | Franz | G10C 3/12 84/439 |
| 4,890,533 | A | * | 1/1990 | Katsuta | G10C 3/20 84/439 |

(Continued)

FOREIGN PATENT DOCUMENTS

| | | |
|---|---|---|
| JP | 2015090373 A | 5/2015 |
| JP | 2017009811 A | 1/2017 |

OTHER PUBLICATIONS

Extended European Search Report (EESR) dated Dec. 13, 2018 issued in counterpart European Application No. 18182854.2.

*Primary Examiner* — Robert W Horn

(74) *Attorney, Agent, or Firm* — Holtz, Holtz & Volek PC

(57) ABSTRACT

A keyboard device includes at least one key and an action mechanism corresponding to the at least one key. The action mechanism includes a transmitter which moves in response to key depression to the at least one key, a hammer member which operates, in response to movement of the transmitter, to apply a load to the depressed key, a first abutting part which is arranged on one of the hammer member and a member which the hammer member abuts, and an elastic part which is arranged on another of the hammer member and the member which the hammer member abuts. At least one part of the elastic part gets over the first abutting part in a process of deforming of the elastic part, thereby a let-off feeling is given to the depressed key.

18 Claims, 8 Drawing Sheets

(56) References Cited

U.S. PATENT DOCUMENTS

| | | | | | |
|---|---|---|---|---|---|
| 4,993,305 | A * | 2/1991 | Franz | G10C 3/12 | 84/439 |
| 5,204,486 | A * | 4/1993 | Kim | G10H 1/346 | 84/433 |
| 5,249,497 | A * | 10/1993 | Niitsuma | G10C 3/12 | 84/247 |
| 5,763,799 | A * | 6/1998 | Kimble | G10C 3/12 | 84/433 |
| 6,147,290 | A | 11/2000 | Uno | | |
| 6,649,821 | B2 * | 11/2003 | Inoue | G10C 3/12 | 84/423 R |
| 6,888,052 | B2 * | 5/2005 | Meisel | G10C 3/12 | 84/16 |
| 6,930,234 | B2 * | 8/2005 | Davis | G10H 1/346 | 84/423 R |
| 7,145,062 | B2 * | 12/2006 | Ishida | G10C 3/12 | 84/35 |
| 7,345,235 | B2 * | 3/2008 | Izutani | G10C 3/12 | 84/718 |
| 7,402,741 | B2 * | 7/2008 | Funaki | G10H 1/346 | 84/423 R |
| 7,582,821 | B2 * | 9/2009 | Watanabe | G10C 3/12 | 84/423 R |
| 7,807,911 | B2 * | 10/2010 | Izutani | G10C 3/12 | 411/451.1 |
| 8,093,480 | B2 * | 1/2012 | Yoshida | G10H 1/346 | 84/439 |
| 8,445,765 | B2 * | 5/2013 | Sawada | G10H 1/346 | 84/423 R |
| 8,889,975 | B2 * | 11/2014 | Komatsu | G10H 1/346 | 84/439 |
| 2010/0282049 | A1 | 11/2010 | Yoshida | | |
| 2018/0268786 | A1 * | 9/2018 | Taniguchi | G10C 3/04 | |

* cited by examiner

KEYBOARD DEVICE

CROSS-REFERENCE TO RELATED APPLICATIONS

This application is based upon and claims the benefit of priority under 35 USC 119 of Japanese Patent Application No. 2017-135896 filed on Jul. 12, 2017, the entire disclosure of which, including the description, claims, drawings, and abstract, is incorporated herein by reference in its entirety.

BACKGROUND OF THE INVENTION

1. Field of the Invention

The present invention relates to a keyboard device.

2. Description of Related Art

An acoustic keyboard instrument produces sound as strings are struck by hammers which interact with keys being depressed. When a key is gradually depressed, a load significantly increases and then drastically decreases (escapes) at a point where the hammer strikes the strings. This reaches the performer's finger and causes a specific clicking feeling (called "let-off").

In digital keyboard instruments which electrically emulates sound of keyboard instruments, this specific clicking feeling (let-off feeling) is simulated so that performers can play the digital keyboard instrument as if it were acoustic keyboard instruments.

For example, Japanese Patent Application Laid Open Publication No. 2017-009811 describes the technique for a digital keyboard instrument with an action mechanism of grand piano type, in which a fixed rail supporting a hammer is provided with an elastic part and a wippen pivoting with a key depression is provided with an abutting part which contacts and deforms the elastic part. The pivoting of the wippen with a key depression causes a clicking feeling as the elastic part deforms to get over the abutting part. This clicking feeling is used to simulate the let-off feeling.

However, the technique described in Japanese Patent Application Laid Open Publication No. 2017-009811, in which a let-off feeling is simulated as the elastic part arranged on the fixed rail is deformed by the movement of the wippen, leaves a lot to be improved, and therefore a structure which generates the let-off feeling more appropriately has been desired.

The present invention has been made in view of the above described situation, and has an advantage of providing a keyboard device which can generate a let-off feeling more appropriately.

SUMMARY OF THE INVENTION

To achieve at least one of the abovementioned objects, according to an aspect of the present invention, a keyboard device includes:

at least one key; and an action mechanism corresponding to the at least one key, wherein the action mechanism includes:

a transmitter which moves in response to key depression to the at least one key;

a hammer member which operates, in response to movement of the transmitter, to apply a load to the depressed key;

a first abutting part which is arranged on one of the hammer member and a member which the hammer member abuts; and an elastic part which is arranged on another of the hammer member and the member which the hammer member abuts, wherein at least one part of the elastic part gets over the first abutting part in a process of deforming of the elastic part, thereby a let-off feeling is given to the depressed key.

According to another aspect of the present invention, a keyboard device includes:

at least one key; and an action mechanism corresponding to the at least one key, wherein the action mechanism includes:

a transmitter which moves in response to key depression to the at least key; and a hammer member which adds a load to the depressed key by moving in response to the transmitter and on which an elastic deformer is arranged, wherein a let-off feeling is given to the depressed key when a first abutting part which abuts the elastic deformer causes the elastic deformer to elastically deform.

DESCRIPTION OF THE PREFERRED EMBODIMENTS

First Embodiment

The first embodiment of the keyboard device 1 in accordance with the present invention is hereinafter described with reference to FIGS. 1 to 6C.

Though the embodiments described below include various limitations that are technically preferred to carry out the present invention, the scope of the present invention is not limited to those embodiments and drawings.

Figure 1:
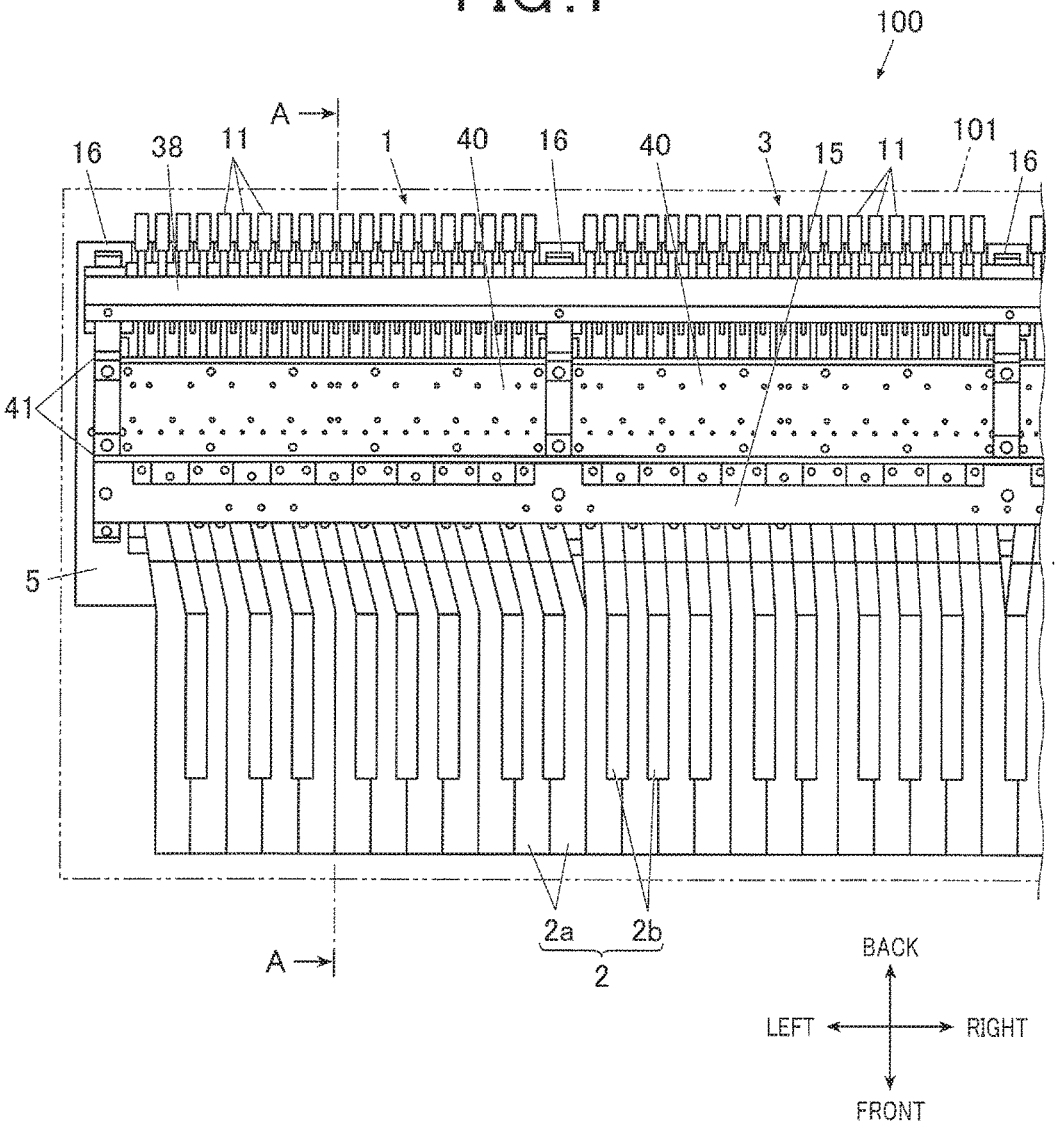
FIG. 1 is a plane view of a digital keyboard instrument in accordance with the first embodiment.
Figure 2A:
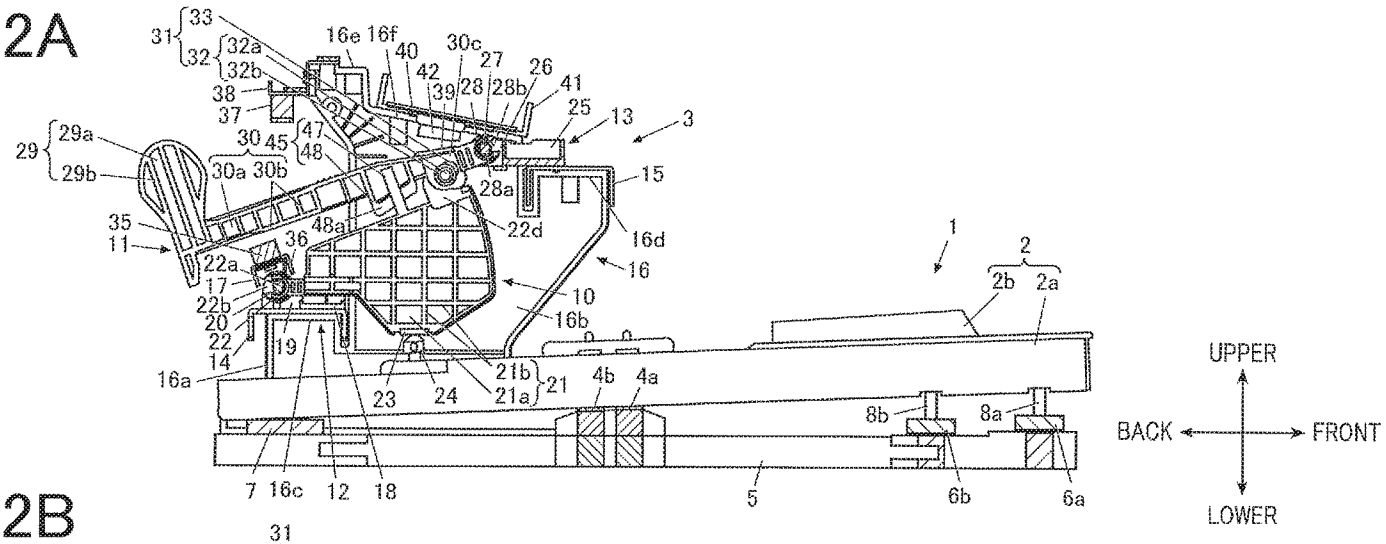
FIG. 2A is a cross-sectional view of a keyboard device taken along line A-A of FIG. 1 in the initial state.
Figure 2B:
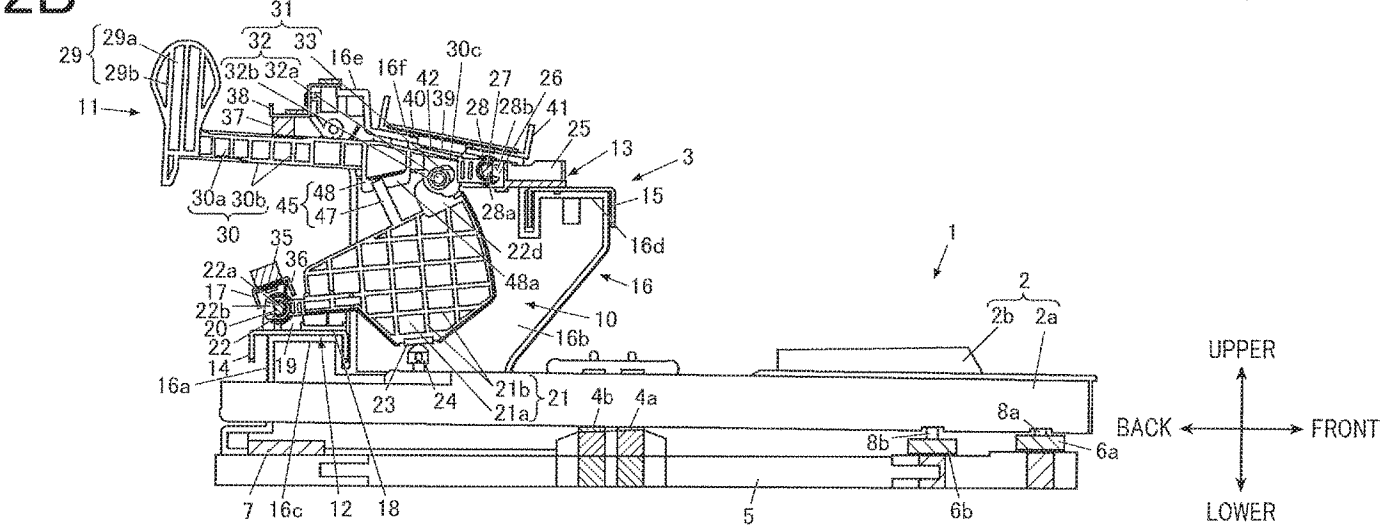
FIG. 2B is a cross-sectional view of a keyboard device taken along line A-A of FIG. 1 in a state where the key is depressed.
Figure 3A:
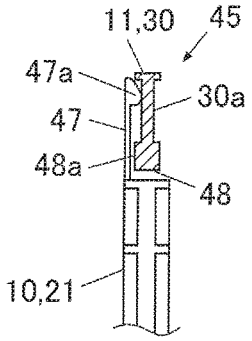
FIG. 3A is a cross-sectional view of a let-off generator in accordance with the first embodiment.
Figure 3B:
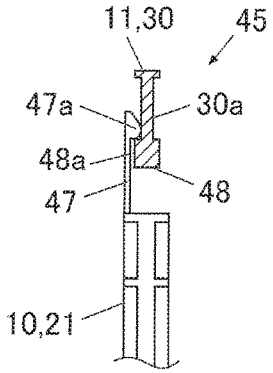
FIG. 3B is a cross-sectional view of a let-off generator in accordance with the first embodiment.
Figure 3C:
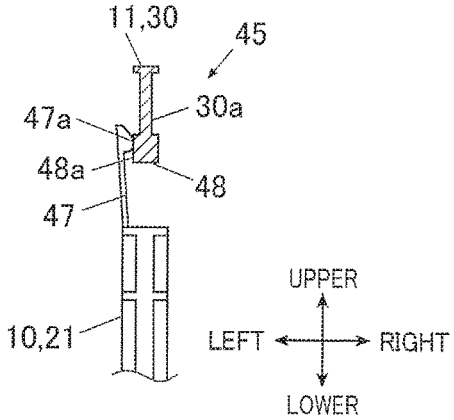
FIG. 3C is a cross-sectional view of a let-off generator in accordance with the first embodiment.
Figure 5:
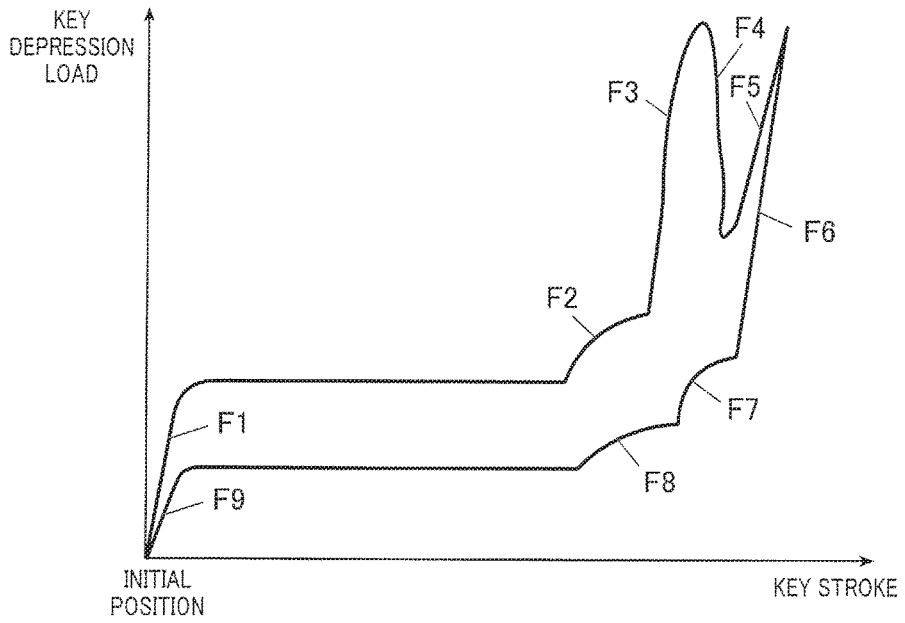
FIG. 5 is a graph showing an example of the key stroke and key depression load characteristics (let-off characteristics) of the keyboard device in accordance with the first embodiment.
Figures 6A, 6B, 6C:
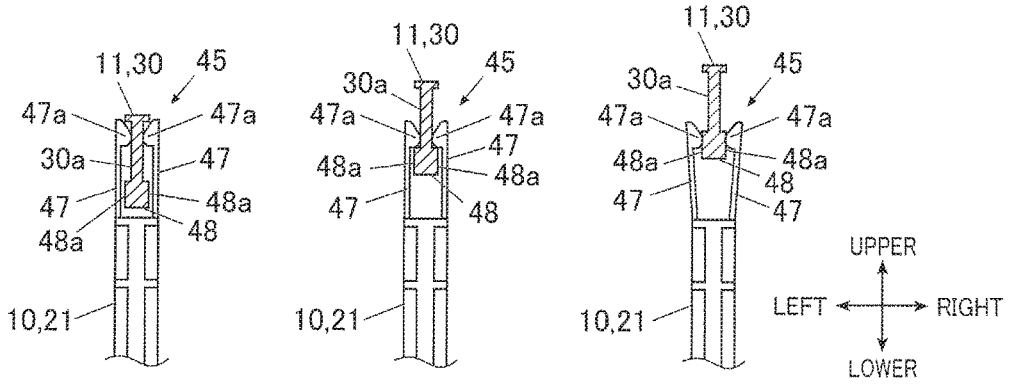
FIG. 6A is a cross-sectional view of a modification example of the let-off generator in accordance with the first embodiment.
FIG. 6B is a cross-sectional view of a modification example of the let-off generator in accordance with the first embodiment.
FIG. 6C is a cross-sectional view of a modification example of the let-off generator in accordance with the first embodiment.

FIG. 1 is a plane view of a digital keyboard instrument 100 which incorporates the keyboard device 1 in accordance with the present embodiment. FIG. 2A is a cross-sectional view of the keyboard device 1 taken along line A-A of FIG. 1 in the initial state. FIG. 2B is a cross-sectional view of the keyboard device 1 taken along line A-A of FIG. 1 in a state where the key is depressed. FIGS. 3A to 3C are cross-sectional views of a let-off generator 45 described later. FIGS. 4A to 4D are drawings for explaining shapes of an elastic hook 47*a* which is provided to the let-off generator 45 described later. FIG. 5 is a graph showing an example of the key stroke and key depression load characteristics (let-off characteristics) of the keyboard device 1. FIGS. 6A to 6C are cross-sectional views of a modification example of the let-off generator 45.

As shown in FIGS. 1 and 2A, the digital keyboard instrument 100 in accordance with the present embodiment includes an instrument case 101, and a keyboard device 1 provided in the instrument case 101.

The keyboard device 1 includes multiple keys 2 which are arranged in a row in the right and left direction of the digital keyboard instrument 100, and action mechanisms 3 which each apply an action load to each of the multiple keys 2 in response to the key depression to the multiple keys 2.

The multiple keys 2 are composed of white keys 2*a* and black keys 2*b* which are arranged to extend in the front and back direction of the digital keyboard instrument 100. The multiple keys 2 are respectively supported by balance pins 4*a* and 4*b* at the approximate middle section in the front and back direction, being pivotable up and down. They are arranged in a row on a base board 5 in such state.

On the base board 5, cushion members 6*a* and 6*b* which seperably abut the lower surface of the front edge of each of the keys 2 are arranged along the array direction of the keys 2. On the base board 5, cushion members 7 which separably abut the lower surface of the back edge of each of the keys 2 are also arranged along the array direction of keys 2. In such way, a key stroke is set to each of the keys 2 with the cushion members 6*a* and 6*b* on the front side and with the cushion member 7 on the back side. Further, on the base board 5, guiding pins 8*a* and 8*b* are arranged upright to prevent each of the keys 2 from moving horizontally.

The action mechanisms 3 are provided with multiple transmitters 10 which each pivot up and down in response to the key depression to the multiple keys 2, and multiple hammer members 11 which apply an action load to each of the multiple keys 2, pivoting up and down in response to the pivoting movement of the multiple transmitters 10. Each of the multiple keys 2 pivots on the balance pins 4*a* and 4*b* counterclockwise (in FIGS. 2A and 2B) by the weight of each of the multiple transmitters 10, and the front edge of the key 2 is pushed up to the initial position. In such way, the initial load is applied to each of the multiple keys 2.

The action mechanisms 3 have multiple transmitter holders 12 which respectively hold the multiple transmitters 10 pivotably, and multiple hammer holding members 13 which respectively hold the multiple hammer members 11 pivotably.

The transmitter holders 12 are provided onto the transmitter supporting rail 14 which is positioned along the array direction of the multiple keys 2. The multiple hammer holding members 13 are provided onto the hammer supporting rail 15 which is positioned along the array direction of the multiple keys 2. The transmitter supporting rail 14 and the hammer holding rail 15 are positioned above the multiple keys 2, being supported by the multiple supporting members 16.

The multiple supporting members 16 are arranged upright on the base board 5, each being positioned at predetermined multiple positions (for example, 5 positions) in the overall length of the array of the multiple keys 2.

The supporting member 16 is made of hard synthetic resin such as ABS resin and provided with a support attaching part 16*a* which is attached to the base board 5 and a bridge part 16*b* which is formed integrally with the support attaching part 16*a* thereon. The supporting member 16 is positioned on the back side of the keys 2 as the bridge part 16*b* protrudes upward on the key 2 with the support attaching part 16*a* being attached on the base board 5.

At the top of the back side of the support attaching part 16*a*, a back side rail supporter 16*c* which supports the transmitter supporting rail 14 is arranged. At the top of the front side of the bridge part 16*b*, a front side rail supporter 16*d* which supports the hammer supporting rail 15 is arranged. A stopper rail supporter 16*e* is arranged at the top of the back side of the bridge part 16*b*. Further, a base board rail supporter 16*f* is arranged at the top of the bridge part 16*b*.

The transmitter supporting rail 14 is formed in a shape such that each longer side of the lining board is bended downward, with the total length covering the overall array of the multiple keys 2. The transmitter supporting rail 14 is attached onto each of the back side rail supporters 16*c* of the multiple supporting members 16 at the predetermined points in the array direction of the multiple keys 2.

On the transmitter supporting rail 14, the multiple transmitter holders 12 are arranged along the array direction of the multiple keys 2, and the multiple stopper supporters 17 are arranged corresponding to the multiple supporting members 16. The multiple stopper supporters 17 are made of metal board and arranged at five points of the transmitter supporting rail 14 which correspond to the multiple supporting members 16, protruding upward on the multiple transmitter holders 12.

The transmitter holders 12 are made of hard synthetic resin such as ABS resin, and have a transmitter holding main body 18 which is attached onto the transmitter supporting rail 14 and multiple axis supporting members 19 to which multiple transmitters 10 are each pivotably attached.

The multiple axis supporting members 19 are formed integrally in the array direction of the multiple keys 2 with the transmitter holding main body 18, corresponding to, for example, 10 or so of the keys 2.

The axis supporting member 19 has a pair of the guiding linings which are formed corresponding to each of the keys 2 at the back edge of the transmitter holding main body 18, and a transmitter holding axis (first pivoting axis) 20 which is formed between the pair of the guiding linings. The pair of the guiding linings form a guide which guides a transmitter joint fitting 22 (described later) of the transmitter 10 to be rotatable, movably holding the transmitter joint fitting 22 of the transmitter 10 from the both sides.

The transmitter 10 is made of hard synthetic resin such as ABS resin, and has a transmitter main body 21 which pivots up and down in response to the key depression to the key 2 to cause the hammer member 11 to pivot up and down, and a transmitter joint fitting 22 which is formed integrally with the transmitter main body 21 and is pivotably attached to the transmitter holding axis 20 of the transmitter holder 12.

The transmitter main body 21 has a thin vertical board 21*a* and multiple ribs 21*b* which are formed in grid on the periphery and both lateral faces of the vertical board 21*a*, and is formed in a waffle shape. The transmitter main body 21 is configured such that the weight of the transmitter 10 is adjusted with the shape of the vertical board 21*a* and the formation density of the multiple ribs 21*b*.

The transmitter main body 21 is formed with the upper front edge being higher than the upper back edge. Accordingly, the upper side of the periphery is inclined downward to the back. An interact supporter 22*d* is arranged at the upper front edge of the transmitter main body 21, protruding upward. The interact supporter 22*d* is configured to move up and down along the lateral face of the hammer member 11 without abutting the hammer member 11. An interact protrusion 32 of an interact controller 31 (described later) is arranged on the lateral face of the interact supporter 22*d*.

On the other hand, the transmitter joint fitting 22 is formed in a shape of a mirrored C (in FIGS. 2A and 2B) in all, and protrudes backward at the back edge of the transmitter main body 21. Accordingly, the transmitter joint fitting 22 is, in the array direction of the multiple keys 2, formed approximately as thick as the transmitter supporting axis 20 which is arranged between the pair of the guiding linings of the axis supporting member 19, and movably inserted between the guiding linings.

The transmitter joint fitting 22 is formed with a joint hole 22*a* which fits the transmitter supporting axis 20 of the transmitter holding member 12 at its center and an insertion opening 22*b* at the back part of the periphery of the joint hole 22*a*. The transmitter holding axis 20 is removably inserted into the insertion opening 22*b*. As the transmitter holding axis 20 is inserted through the insertion opening 22*b* into the joint fitting hole 22*a*, the transmitter joint fitting 22 is pivotably attached to the transmitter holding axis 20.

A transmitter felt 23 is arranged at the lower front edge of the transmitter main body 21. The transmitter felt 23 abuts, from the bottom side, a capstan 24 which is arranged at the top of back side of the key 2. In such way, the transmitter 10 is configured to pivot on the transmitter holding axis 20 counterclockwise (in FIGS. 2A and 2B), being pushed up by the capstan 24 of the key 2 which abuts the transmitter felt 23 from the bottom side, when the key 2 is depressed.

The hammer supporting rail 15 is formed, like the transmitter supporting rail 14, in a shape such that each longer side of the lining board is bended downward, with the total length covering the overall array of the multiple keys 2. The hammer supporting rail 15 is attached on each of the front side rail supporters 16*d* of the multiple supporting members 16 at the predetermined points in the array direction of the multiple keys 2. On the hammer supporting rail 15, the multiple hammer holding members 13 are arranged along the array direction of the multiple keys 2.

The hammer holding member 13 is made of hard synthetic resin such as ABS resin, and has an attachment main body 25 forming a rail almost in a shape of box with an open top and multiple axis supporting members 26 which are formed integrally along the array direction of the multiple keys 2 at the back edge of the attachment main body 25.

The multiple axis supporting members 26 are arranged along the array direction of the multiple keys 2, corresponding to, for example, 10 or so of the keys 2. The axis supporting member 26 is configured to prevent the hammer member 11 from moving horizontally, with the hammer member 11 being movably attached to it.

The axis supporting member 26 has a pair of guiding linings which are formed corresponding to each of the transmitters 10 at the back edge of the attachment main body 25 and a hammer holding axis (second pivoting axis) 27 which is formed between the pair of the guiding linings. The pair of the guiding linings form a guide which guides a hammer joint fitting 28 (described later) of the hammer member 11 to be rotatable, movably holding the hammer joint fitting 28 of the hammer member 11 from the both sides.

The hammer member 11 is made of hard synthetic resin such as ABS resin, and has a hammer joint fitting 28 which is a pivotal center, a hammer 29 with a predetermined weight, and a hammer arm 30 which connects the hammer joint fitting 28 and the hammer 29, which are integrally formed.

The hammer 29 is arranged at the back edge of the hammer arm 30. The hammer 29 has a vertical board 29*a* in a shape of a flat spoon, and is formed integrally with multiple ribs 29*b* on the periphery and both lateral faces of the vertical board 29*a*. The weight of the hammer 29 is adjusted with the shape of the vertical board 29*a* and the formation density of the multiple ribs 29*b*.

The hammer joint fitting 28 is formed in a shape of a C (in FIGS. 2A and 2B) in all, like the transmitter joint fitting 22, and protrudes forward at the front edge of the hammer arm 30. The hammer joint fitting 28 is, in the array direction of the multiple keys 2, approximately as long as the hammer holding axis 27 which is arranged between the pair of the guiding linings of the axis holder 26, and movably inserted between the pair of the guiding linings.

The hammer joint fitting 28 is formed with a fitting hole 28*a* which fits the hammer holding axis 27 of the hammer holder 13 at its center and an insertion opening 28*b* at the front part of the periphery of the joint hole 28*a*. The hammer holding axis 27 is removably inserted into the insertion opening 28*b*. As the hammer holding axis 27 is inserted through the insertion opening 28*b* into the joint fitting hole 28*a*, the hammer joint fitting 28 is pivotably attached to the hammer holding axis 27.

The hammer arm 30 has a horizontal board 30*a* which is approximately as long as the transmitter 10 in the front and back direction and is integrally formed with multiple backing ribs 30*b* which are formed on the upper and bottom periphery and both lateral faces of the horizontal board 30*a*. The hammer joint fitting 28 is integrally formed with the hammer arm 30 at its front edge.

An interacting attachment 30*c* is arranged at the lower front edge of the hammer arm 30, protruding downward. The interacting attachment 30*c* faces the lateral face of the interact supporter 22*d* of the transmitter 10, and is configured to be movable up and down along the lateral face of the interact supporter 22*d* in that state. The interacting attachment 30*c* is provided with a guiding hole 33 which guides the interact protrusion 32 of an interact controller 31 (described later).

That is, the interact controller 31 has the interact protrusion 32 which is arranged at the interact supporter 22*d* of the transmitter 10, and a guiding hole 33 which is arranged on the interacting attachment 30*c* of the hammer member 11 and guides the interact protrusion 32. In such way, the interact controller 31 is configured to control the pivoting movement of the hammer member 11 along with the pivoting movement of the transmitter 10 in response to the key depression to the key 2, by the movement of the interact protrusion 32 relative to the guiding hole 33.

The interact protrusion 32 of the interact controller 31 has a protrusion main body 32*a* in a shape of a pillar and a cushion member 32*b* in a shape of a pipe which is arranged on the periphery of the protrusion main body 32*a*.

The protrusion main body 32*a* is formed integrally at the upper front edge of the interact supporter 22*d* which is arranged on the transmitter main body 21 of the transmitter 10, protruding in the array direction of the multiple keys 2. The protrusion main body 32*a* is movably inserted into the guiding hole 33 which is arranged on the interacting attachment 30*c* of the hammer member 11 with the cushion member 32*b*.

The cushion member 32*b* is made of synthetic resin which has elasticity such as urethane resin or silicone resin. The cushion member 32*b* is formed almost in a shape of a pipe and moves while touching the inner periphery of the guiding hole 33.

On the other hand, the guiding hole 33 of the interact controller 31 is a long hole into which the interact protrusion 32 is movably inserted, and arranged at the interacting attachment 30*c* which is arranged on the lower front edge of the hammer arm 30 of the hammer member 11. The guiding hole 33 is a long hole which is formed long along the comparative movement path (traveling path) of the interact protrusion 32 while the transmitter 10 pivots on the transmitter holding axis 20 and the hammer member 11 pivots on the hammer holding axis 27.

Specifically, the guiding hole 33 is arranged with its long axis being inclined downward to the back. The length of the guiding hole 33 in the direction perpendicular to the long axis (hole width) is approximately equal to the external diameter of the interact protrusion 32, or the external diameter of the cushion member 32*b*, and the long axis is one and a half times to twice the length of the external diameter of the interact protrusion 32.

The guiding hole 33 is configured so that the interacting attachment 30*c* of the hammer member 11 does not touch directly the interact supporter 22*d* of the transmitter 10 as the cushion member 32*b* of the interact protrusion 32 elastically touches the inner periphery the guiding hole 33, when the interact protrusion 32 moves while being inserted into the guiding hole 33.

In such way, the interact controller 31 is configured to control the pivoting movement of the hammer member 11 by the movement of the interact protrusion 32 relative to the guiding hole 33, as the transmitter 10 pivots corresponding to the depressed key 2 and the hammer member 11 is caused to interact to pivot along with the pivoting movement of the transmitter 10.

That is, the transmitter 10 pivots counterclockwise (in FIGS. 2A and 2B) on the transmitter holding axis 20 in response to the key depression to the key 2, and the interact protrusion 32 abuts the upper front edge of the guiding hole 33 with the transmitter 10 pivoting to push up the upper front edge of the guiding hole 33. Then the interact controller 31 causes the hammer member 11 to pivot clockwise (in FIGS. 2A and 2B) on the hammer holding axis 27.

The interact controller 31 is configured to cause the transmitter 10 and the hammer member 11 to interact to pivot, no matter whether the pivoting speed of the transmitter 10 and the pivoting speed of the hammer member 11 match or differ, as the interact protrusion 32 is set to the movable state along the guiding hole 33 when the hammer member 11 is pushed up.

The interact controller 31 is configured such that the transmitter 10 pivots on the transmitter holding axis 20 clockwise (in FIGS. 2A and 2B) by its own weight and the hammer member 11 pivots on the hammer holding axis 27 counterclockwise (in FIGS. 2A and 2B) by its own weight, as the interact protrusion 32 is movable relatively to the guiding hole 33 when the depressed key 2 returns back to its initial position.

The interact controller 31 is further configured such that the interact protrusion 32 abuts or approaches the upper front edge of the guiding hole 33 as the interact protrusion 32 moves toward the upper front edge of the guiding hole 33 when the transmitter 10 and the hammer member 11 return back to the initial position.

The hammer member 11 is regulated at the lower limit position which is the initial position, with the lower back edge of the hammer arm 30 abutting the lower limit stopper 35 from the upper side. The lower limit stopper 35 is attached onto the lower limit stopper rail 36 which is supported by multiple stopper supporters 17 arranged on the transmitter supporting rail 14.

Accordingly, the hammer member 11 is regulated at the initial position, inclined downward to the back, as the lower back edge of the hammer arm 30 abuts the lower limit stopper 35 from the upper side when pivoting counterclockwise (in FIGS. 2A and 2B) on the hammer holding axis 27 by its own weight.

The upper limit position of the hammer member 11 is regulated as the upper back edge of the hammer arm 30 abuts the upper limit stopper 37 from the lower side in response to the key depression to the key 2. The upper limit stopper 37 is attached onto the lower surface of the upper limit stopper rail 38 which is attached onto each of the stopper rail supporters 16*e* of the multiple supporting members 16.

Accordingly, the upper limit position of the hammer member 11 is regulated as the upper back edge of the hammer arm 30 abuts the upper limit stopper 37 from the lower side when the hammer arm 30 pivots clockwise (in FIGS. 2A and 2B) on the hammer holding axis 27 of the hammer holder 13.

Further, a switch pressor 39 is formed at the upper front edge of the hammer arm 30. Above the switch pressor 39, a switch board 40 is arranged with a pair of board supporting rails 41.

The pair of board supporting rails 41 are each a band board with an L-shaped cross section, with the length covering the overall array of the multiple keys 2. The pair of board supporting rails 41 are attached onto each of the board rail supporters 16*f* of the multiple supporting members 16 at its horizontal face, spaced at predetermined intervals.

The switch board 40 is divided into multiple parts with a length, for example, corresponding to 20 or so of the keys 2 in the array direction of the multiple keys 2 (see FIG. 1), and attached onto the pair of board supporting rails 41.

A rubber switch 42 is arranged on the lower surface of each of the switch boards 40. Inside the rubber switch 42, a movable contact (not shown in the drawings) which removably touches a fixed contact (not shown in the drawings) arranged on the lower surface of the switch board 40 is arranged corresponding to the multiple hammer arms 30. In such way, the rubber switch 42 is configured such that the movable contact touches the fixed contact as the hammer member 11 pivots clockwise (in FIGS. 2A and 2B) on the hammer holding axis 27 of the hammer holder 13 and is pressed from the lower side by the switch pressor 39 of the hammer arm 30.

A sound generator (not shown in the drawings) is arranged on the switch board 40. The sound generator generates pitched sound in response to a switch signal of the rubber switch 42 which is output according to the strength of depression of the key 2, and causes a speaker (not shown in the drawings) to emit pitched sound based on the signal of pitched sound.

The action mechanism 3 has a let-off generator 45 which generates a clicking feeling to the depressed key 2, before the hammer member 11 reaches the upper limit position and gives the clicking feeling to a user as a let-off feeling.

The let-off generator 45 has an elastic deformer 47 which is arranged on the transmitter main body 21 of the transmitter 10, and a pressor 48 which is arranged on the hammer arm 30 of the hammer member 11 and elastically deforms the elastic deformer 47 with the pivoting movement of the transmitter 10 and the hammer member 11.

The elastic deformer 47 is arranged on the upper surface of the transmitter main body 21 upward so as to be perpendicular to the inclined upper surface of the transmitter main body 21, at a position slightly back of the interact supporter 22*d* of the upper front edge, as shown in FIGS. 2A, 2B, and 3A. The elastic deformer 47 is integrally formed with the transmitter main body 21 with a thickness elastically deformable in the right and left direction, and arranged at an edge of the upper surface of the transmitter main body 21 in the thickness direction (right and left direction) (left edge in FIG. 3).

The elastic deformer 47 is formed integrally with an elastic hook 47*a* at its tip (upper edge). The elastic hook 47*a*, which the pressor 48 of the hammer member 11 abuts, is a protrusion protruding inward in the thickness direction of the transmitter main body 21 (right direction in FIG. 3). The elastic hook 47*a* is positioned in the right and left direction of the hammer arm 30, without touching the horizontal board 30*a* of the hammer arm 30 in the initial state where the key 2 is not depressed.

Figure 4A:
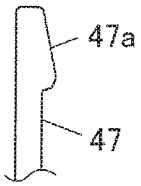
FIG. 4A is a drawing for explaining a shape of an elastic hook.
Figure 4B:
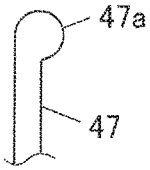
FIG. 4B is a drawing for explaining a shape of an elastic hook.
Figure 4C:
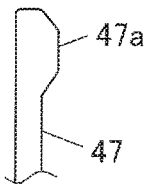
FIG. 4C is a drawing for explaining a shape of an elastic hook.
Figure 4D:
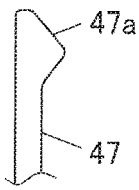
FIG. 4D is a drawing for explaining a shape of an elastic hook.

In the elastic hook 47*a*, a protrusion face protruding inward in the thickness direction of the transmitter main body 21 is formed in an inclined shape protruding gradually higher from the tip to the lower side, as shown in FIG. 4A, and formed with an R corner at the lower edge. The protrusion face may be variable according to a desired characteristics of let-off, as long as being formed in a shape such that the elastic deformer 47 is elastically deformed outward in the thickness direction of the transmitter main body 21 by abutting the pressor 48 one above another. Specifically, the protrusion face may be formed in a shape of semicircle (or hemisphere) in the side view at least with R corners at both upper and lower edges as shown in FIG. 4B, in a shape with chamfered corners (tapers) at both upper and lower edges as shown in FIG. 4C, or in a shape of triangle in the side view where the chemfered corners (tapers) at both upper and lower edges meet directly as shown in FIG. 4D.

The pressor 48 is a first abutting part in accordance with the present invention, which is formed in a shape such that the part slightly back of the interacting attachment 30*c* at the upper front edge protrudes downward on the hammer arm 30, as shown in FIGS. 2A, 2B, and 3A. A backing rib 30*b* is arranged on the bottom periphery of the pressor 48, like other parts of the hammer arm 30. The backing rib 30*b* on the bottom periphery is a second abutting part in accordance with the present invention, and is also an abutting part 48*a* which abuts the elastic hook 47*a* of the elastic deformer 47.

The pressor 48 is configured such that the abutting part 48*a* abuts the elastic hook 47*a* and elastically deforms the elastic deformer 47 when the transmitter 10 pivots on the transmitter holding axis 20 and the hammer member 11 pivots on the hammer holding axis 27, as shown in FIGS. 2A, 2B, 3A, 3B, and 3C.

That is, the pressor 48 is configured to elastically deform the elastic deformer 47 outward in the thickness direction of the transmitter main body 21 (leftward in FIGS. 3A to 3C) and causes the elastic hook 47*a* to get over the abutting part 48*a*, when the transmitter 10 and the hammer member 11 pivot and the abutting part 48*a* abuts the lower edge of the elastic hook 47*a*.

In other words, the elastic deformer 47 and the pressor 48 are each arranged at a position where the distance between the transmitter 10 and the hammer member 11 widens in response to the key depression. The elastic deformer 47 and the pressor 48 are configured not to abut each other when the distance between the transmitter 10 and the hammer member 11 is within a predetermined first distance, but to abut each other when the distance between the transmitter 10 and the hammer member 11 is over the first distance.

Accordingly, the let-off generator 45 causes the key depression load to be heavier as the abutting part 48*a* of the pressor 48 arranged on the hammer member 11 abuts the elastic hook 47*a* of the elastic deformer 47 of the transmitter 10 from the lower side, before the hammer member 11 reaches the upper limit position as the transmitter 10 is pushed up by the key depression to the key 2 and pivots on the transmitter holding axis 20.

The let-off generator 45 generates a clicking feeling at the transmitter 10 to give a let-off feeling to the key 2 where the key depression load gets abruptly lighter, as the abutting part 48*a* elastically deforms the elastic deformer 47 and causes the elastic hook 47*a* to get over the abutting part 48*a* when the abutting part 48*a* of the pressor 48 abuts the lower edge of the elastic hook 47*a* of the elastic deformer 47.

Further, in the let-off generator 45, the up and down movement of the hammer member 11 is guided as the elastic deformer 47 abuts the pressor 48 and is elastically deformed (displaced).

Hereinafter the mechanism of the keyboard device 1 is explained.

First, the initial state where the key 2 is not depressed is explained.

In the keyboard device 1, as shown in FIG. 2A, the transmitter 10 pivots on the transmitter holding axis 20 of the transmitter holder 12 clockwise (in FIGS. 2A and 2B) by its own weight in the initial state where the key 2 is not depressed, and the transmitter felt 23 which is arranged on the lower surface of the transmitter main body 21 abuts the capstan 24 of the key 2 from the upper side.

In this state, the weight of the transmitter 10, or the weight given by the shape and thickness of the vertical board 21*a* of the transmitter main body 21 and the formation density of the multiple ribs 21*b*, is applied to the capstan 24 of the key 2 from the upper side. Accordingly, the key 2 pivots on the balance pins 4*a* and 4*b* counterclockwise (in FIGS. 2A and 2B), being pushed by the transmitter 10. The key 2 is then regulated at the initial position and the transmitter 10 is also regulated at the initial position, as the back edge part of the key 2 abuts the cushion member 7.

In this state, the hammer member 11 pivots on the hammer holding axis 27 of the hammer holder 13 counterclockwise (in FIGS. 2A and 2B) by its own weight, and is regulated at the lower limit position as the hammer arm 30 abuts the lower limit stopper 35 (though not completely in FIG. 2A). In this state, the switch pressor 39 of the hammer member 11 is arranged at a position separate from the rubber switch 42 of the switch board 40 therebelow. Accordingly, the rubber switch 42 is in the off state, as the movable contact separates from the fixed contact.

Hereinafter an example where the key 2 in the initial state is depressed to make sound is explained.

In this example, when the key 2 is depressed, the key 2 pivots on the balance pins 4*a* and 4*b* clockwise (in FIGS. 2A and 2B), and the capstan 24 of the key 2 pushes up the transmitter 10, as shown in FIG. 2B. At this point, the weight of the transmitter 10 is given to the key 2 as the initial load.

Accordingly, the transmitter 10 pivots on the transmitter holding axis 20 of the transmitter holder 12 counterclockwise (in FIGS. 2A and 2B) against its own weight. The pivoting movement of the transmitter 10 is then transmitted to the hammer member 11 by the interact controller 31 and the hammer member 11 is pushed up against its own weight. That is, when the transmitter 10 pivots counterclockwise (in FIGS. 2A and 2B), the interact protrusion 32 abuts the upper front edge of the guiding hole 33 along with the pivoting movement of the transmitter 10 to push up the upper front edge of the guiding hole 33.

Then the hammer member 11 pivots on the hammer holding axis 27 of the holder 13 clockwise (in FIGS. 2A and 2B), and applies an action load to the key 2. That is, the action load is applied to the key 2 with the moment of inertia of the hammer member 11, when the hammer member 11 pivots on the hammer holding axis 27 clockwise (in FIGS. 2A and 2B). At this point, the key depression load drastically increases as shown by F1 in FIG. 5.

In such way, as the hammer member 11 pivots on the hammer holding axis 27 clockwise (in FIGS. 2A and 2B), the switch pressor 39 of the hammer arm 30 presses from the bottom side the rubber switch 42 arranged on the switch board 40. Accordingly, the rubber switch 42 is elastically deformed, and the movable contact inside it touches the fixed contact. At this point, the key depression load again increases as shown by F2 in FIG. 5.

When the movable contact inside the rubber switch 42 touches the fixed contact, a switch signal is provided to the sound generator according to the depressed key 2, and pitched sound data is generated in the sound generator. The pitched sound is then produced from the speaker based on the pitched sound data generated.

As the transmitter 10 pivots further on the transmitter holding axis 20 and the hammer member 11 pivots further on the hammer holding axis 27, a let-off feeling is given to the user by the let-off generator 45 via the depressed key 2.

That is, the abutting part 48*a* of the pressor 48 of the hammer member 11 abuts the elastic hook 47*a* of the elastic deformer 47 of the transmitter 10 from the bottom side, as shown in FIG. 3B, before the hammer member 11 reaches the upper limit position as the transmitter 10 and the hammer member 11 pivot in response to the key depression to the key 2.

When the transmitter 10 and the hammer member 11 further pivot from this state, as shown in FIG. 3C, the elastic deformer 47 is elastically deformed in the right and left direction, as the abutting part 48*a* of the pressor 48 presses the R corner at the lower edge of the elastic hook 47*a* from the bottom side. That is, the let-off generator 45 gives counter force against the direction of widening the distance between the transmitter 10 and the hammer member 11, when the distance between the transmitter 10 and the hammer member 11 is over the predetermined first distance and the elastic deformer 47 is elastically deformed as the elastic deformer 47 and the pressor 48 abut each other. Accordingly, the key depression load drastically increases as shown by F3 in FIG. 5.

When the elastic hook 47*a* completely gets over the abutting part 48*a* of the pressor 48 downward, the key depression load drastically decreases, as shown by F4 in FIG. 5. In such way, a clicking feeling is generated in the transmitter 10, and a let-off feeling is given to the key 2 by the clicking feeling, where the key depression load drastically decreases.

After that, as the hammer member 11 pivots further on the hammer holding axis 27, the hammer arm 30 abuts the upper limit stopper 37 from the bottom side and the pivoting movement of the hammer member 11 is regulated to stop. At this point, the key depression load again drastically increases as shown by F5 in FIG. 5. The key touch similar to that of the acoustic piano is obtained in such way.

When the key depression to the key 2 ends and the key release movement (returning movement) starts where the key 2 returns back to the initial position, the key depression load drastically decreases, as shown by F6 in FIG. 5. And when the pressor 48 of the let-off generator 45 abuts the elastic hook 47*a* of the elastic deformer 47 from the upper side, the key depression load decreases a bit slowly, as shown by F7 in FIG. 5. That is, the let-off generator 45 does not give counter force against the direction of narrowing the distance between the transmitter 10 and the hammer member 11, when the distance between the transmitter 10 and the hammer member 11 is back to within the first distance in response to the key release movement and the elastic deformer 47 is released from the elastic deformation as the elastic deformer 47 and the pressor 48 no longer abut each other.

After that, the key depression load decreases more slowly, as shown by F8 in FIG. 5, as the switch pressor 39 of the hammer arm 30 is pushed down by the elastic returning force of the rubber switch 42 arranged on the switch board 40. The hammer member 11 pivots further from that state on the hammer holding axis 27, and the switch pressor 39 of the hammer arm 30 separate from the rubber switch 42 of the switch board 40 therebelow. Then as the transmitter 10 pushes down the back side of the key 2 by its own weight, the key depression load drastically decreases, as shown by F9 in FIG. 5, and the key 2 returns back to the initial position.

As described hereinbefore, in accordance with the present embodiment, the action mechanism 3 which is arranged corresponding to each of the multiple keys 2 has the elastic deformer 47 and the pressor 48. Further, the pressor 48 includes the let-off generator 45 which is arranged on the hammer member 11. The let-off generator 45 elastically deforms the elastic deformer 47 as the elastic deformer 47 and the pressor 48 abut each other with the movement of the hammer member 11, and gives the let-off feeling to the depressed key 2.

Accordingly, compared to the conventional technique where the elastic part arranged on the fixed rail generates the clicking feeling, it is possible to more appropriately generate the let-off feeling.

The pressor 48 is arranged on the hammer member 11 on one hand, and the elastic deformer 47 is arranged on the transmitter 10 on the other hand, in the let-off generator 45.

In such way, the elastic deformer 47 and the pressor 48 may abut each other appropriately with the relative movement of the hammer member 11 and the transmitter member 10, and eventually it is possible to more appropriately generate the let-off feeling.

The elastic deformer 47 has the elastic hook 47*a* which abuts the pressor 48 at its tip. The elastic hook 47*a* has R corners or chemfered corners on the face abutting the pressor 48 at the both edges in the up and down direction of the pressor 48 relatively moving.

Accordingly, the elastic deformer 47 may be elastically deformed appropriately. Even when the elastic deformer 47 and the pressor 48 are out of the predetermined designated positions, they can easily be returned to the designated positions, guiding each other with the R corners or chemfered corners.

In the first embodiment described above, the elastic deformer 47 of the let-off generator 45 is arranged at one edge in the thickness direction (right and left direction) of the upper surface of the transmitter main body 21. However, the elastic deformer 47 may be arranged on both left and right sides of the pressor 48 (hammer member 11), holding the pressor 48 of the hammer arm 30 from both sides, as shown in FIGS. 6A, 6B, and 6C.

In such way, the movement of the pressor 48 relative to the elastic deformer 47 may be guided, and further the transmitter 10 and the hammer member 11 may be prevented from horizontally shaking in the right and left direction relatively and attain stable action.

In other words, when the first abutting part 48*a* moves upward (upper direction in FIGS. 6A to 6C) as shown in FIG. 6A, the first abutting part 48*a* and the elastic part 47 catch each other as shown in FIG. 6B. As the first abutting part 48*a* moves further upward, the first abutting part 48*a* presses at least one part 47*a* of the elastic part 47 in the right and left direction (array direction of the keys). This starts a process of deforming of the elastic part 47. When the first abutting part 48*a* moves further upward, the first abutting part 48*a* and at least one part 47*a* of the elastic part 47, which have caught each other, get released from each other, as shown in FIG. 6C. At the timing of this releasement, a let-off feeling is given to the depressed key.

The elastic deformer 47 is arranged on the transmitter 10 and the pressor 48 is arranged on the hammer member 11. Otherwise, whichever one of the elastic deformer 47 and the pressor 48 is to be arranged on the hammer member 11.

Second Embodiment

Hereinafter the second embodiment of the keyboard device in accordance with the present invention is explained with reference to FIGS. 7 to 9C.

The second embodiment differs from the first embodiment in configuration of a let-off generator. Therefore, the following description is focused on the difference from the first embodiment.

Figure 7:
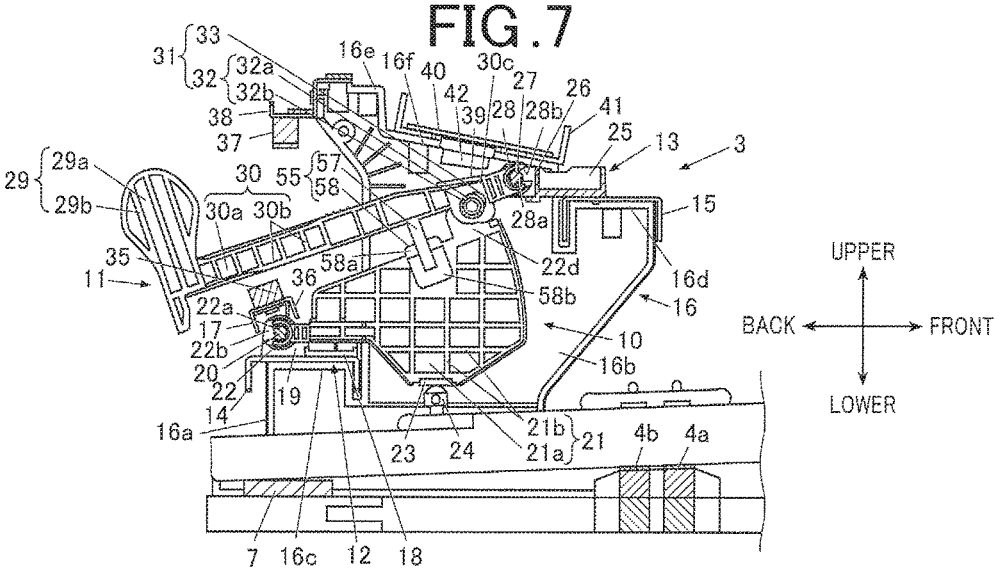
FIG. 7 is a cross-sectional view of the keyboard device in accordance with the second embodiment.

FIG. 7 is a cross-sectional view of the keyboard device 1 in accordance with the present embodiment. FIG. 8 is a cross-sectional view of the let-off generator 55 in accordance with the present embodiment. FIGS. 9A to 9C are cross-sectional views of the let-off generator 55 in the modification example.

As shown in FIG. 7, the keyboard device 1 in accordance with the present embodiment has a let-off generator 55, instead of the let-off generator 45 in the first embodiment described above.

The let-off generator 55 has an elastic deformer and a pressor whose components or positioning are opposite to those of the let-off generator 45 in the first embodiment.

Specifically, the let-off generator 55 has an elastic deformer 57 which is arranged on the hammer arm 30 of the hammer member 11, and a pressor 58 which is arranged on the transmitter main body 21 of the transmitter 10 and elastically deforms the elastic deformer 57 along with the pivoting movement of the transmitter 10 and the hammer member 11.

Figure 8A:
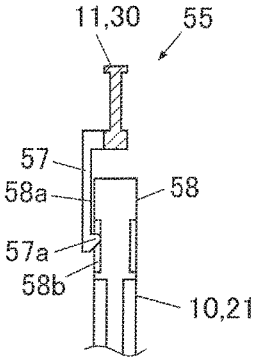
FIG. 8A is a cross-sectional view of a let-off generator in accordance with the second embodiment.

The elastic deformer 57 is arranged on the lower surface of the hammer arm 30 downward so as to be perpendicular to the inclined bottom surface of the hammer arm 30, at a position slightly back of the interact attachment 30*c* of the upper front edge, as shown in FIGS. 7 and 8A. The elastic deformer 57 is integrally formed with the hammer arm 30 with a thickness elastically deformable in the right and left direction, and arranged at an end of the lower side of the hammer arm 30 (left edge in FIGS. 8A to 8C) in the thickness direction of the hammer arm 30 (right and left direction).

The elastic deformer 57 is formed integrally with an elastic hook 57*a* at its tip (lower edge). The elastic hook 57*a* is a protrusion protruding inward in the thickness direction of the hammer arm 30 (right direction in FIGS. 8A to 8C), which the pressor 58 of the transmitter 10 abuts. The elastic hook 57*a* is positioned in the right and left direction of the hammer arm 30, without contacting the transmitter main body 21 in the reentrant part 58*b* of the transmitter main body 21 in the initial state where the key 2 is not depressed.

The other sections of the elastic deformer 57 are configured similarly to those of the elastic deformer 47 in the first embodiment.

The pressor 58 is formed in a shape such that the part slightly back of the interacting supporter 22*d* at the upper front edge protrudes upward on the transmitter main body 21. The reentrant part 58*b* is formed on the lateral side of the transmitter main body 21 positioned at a relatively lower part of the pressor 58. The reentrant part 58*b* is formed at such a depth that it does not touch the elastic hook 57*a* of the elastic deformer 57 in the initial state.

The lateral upper edge of the pressor 58, which is above the reentrant part 58*b*, is an abutting part 58*a* which abuts the elastic hook 57*a* of the elastic deformer 57.

Figure 8B:
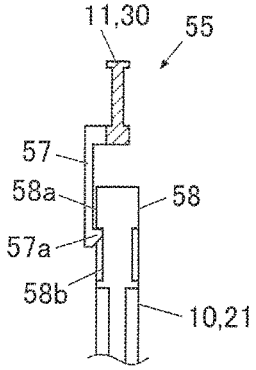
FIG. 8B is a cross-sectional view of a let-off generator in accordance with the second embodiment.
Figure 8C:
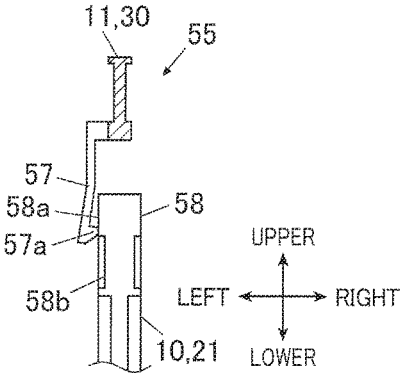
FIG. 8C is a cross-sectional view of a let-off generator in accordance with the second embodiment.
Figure 9A:
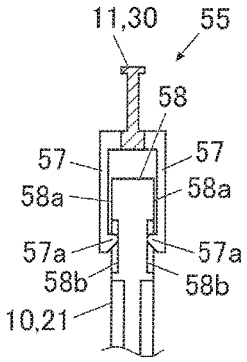
FIG. 9A is a cross-sectional view of a modification example of the let-off generator in accordance with the second embodiment.
Figure 9B:
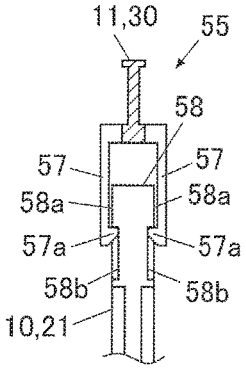
FIG. 9B is a cross-sectional view of a modification example of the let-off generator in accordance with the second embodiment.
Figure 9C:
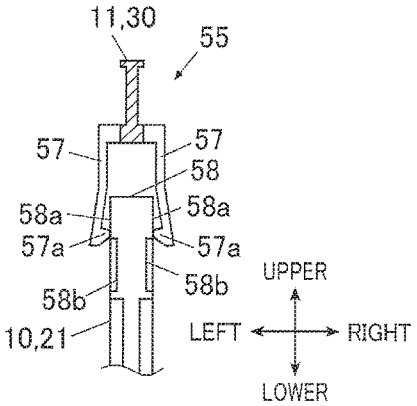
FIG. 9C is a cross-sectional view of a modification example of the let-off generator in accordance with the second embodiment.

The pressor 58 is configured such that the abutting part 58*a* abuts the elastic hook 57*a* and elastically deforms the elastic deformer 57 when the transmitter 10 pivots on the transmitter holding axis 20 and the hammer member 11 pivots on the hammer holding axis 27, as shown in FIGS. 8A to 8C.

That is, the pressor 58 is configured to elastically deform the elastic deformer 57 outward in the thickness direction of the transmitter main body 21 (leftward in FIGS. 8A to 8C) and causes the elastic hook 57*a* to get over the abutting part 58*a*, when the transmitter 10 and the hammer member 11 pivot and the abutting part 58*a* abuts the upper edge of the elastic hook 57*a*.

In other words, when the elastic part 57 moves upward (upper direction in FIGS. 8A to 8C) as shown in FIG. 8A, the first abutting part 58*a* and the elastic part 57 catch each other as shown in FIG. 8B. As the elastic part 57 moves further upward, the first abutting part 58*a* presses at least one part 57*a* of the elastic part 57 in the right and left direction (array direction of the keys). This starts a process of deforming of the elastic part 57. When the elastic part 57 moves further upward, the first abutting part 58*a* and at least one part 57*a* of the elastic part 57, which have caught each other, get released from each other, as shown in FIG. 8C. At the timing of this releasement, a let-off feeling is given to the depressed key.

In such way, the let-off generator 55 may function similarly to the let-off generator 45 in the first embodiment.

Therefore, according to the second embodiment described hereinbefore, the effect similar to that of the first embodiment can be obtained.

In the second embodiment described above, the elastic deformer 57 of the let-off generator 55 is arranged at one edge in the thickness direction (right and left direction) of the hammer arm 30. However, as shown in FIGS. 9A to 9C, the elastic deformer 57 may be arranged on both left and right sides of the pressor 58 (transmitter 10), holding the pressor 58 of the transmitter main body 21 from both sides, as in the first embodiment described above.

In such way, the movement of the pressor 58 relative to the elastic deformer 57 may be guided, and further the transmitter 10 and the hammer member 11 may be prevented from horizontally shaking in the right and left direction relatively and attain stable action.

Third Embodiment

Hereinafter the third embodiment of the keyboard device in accordance with the present invention is explained with reference to FIGS. 10A and 10B.

The third embodiment differs from the first embodiment in configuration of a let-off generator. Therefore, the following description is focused on the difference from the first embodiment.

Figure 10A:
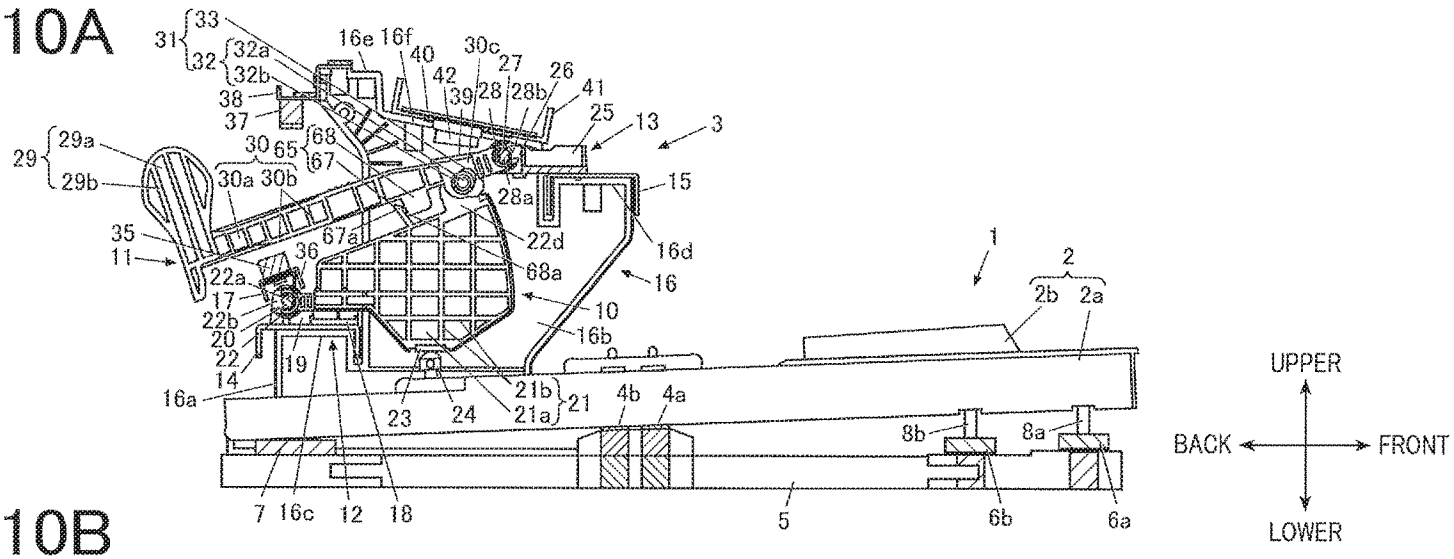
FIG. 10A is a cross-sectional view of the keyboard device in accordance with the third embodiment.
Figure 10B:
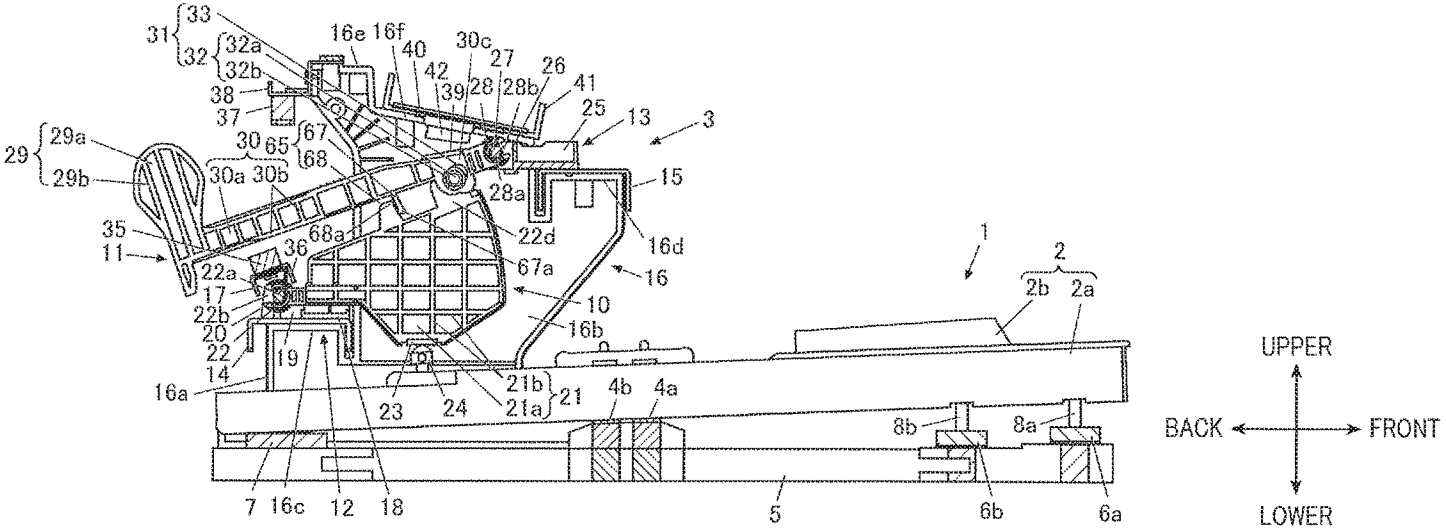
FIG. 10B is a cross-sectional view of the keyboard device in a modification example of the third embodiment.

FIG. 10A is a cross-sectional view of the keyboard device 1 in accordance with the present embodiment, and FIG. 10B is a cross-sectional view of a modification example thereof.

As shown in FIG. 10A, the keyboard device 1 in accordance with the present embodiment has a let-off generator 65, instead of the let-off generator 45 in the first embodiment described above.

The let-off generator 65 differs from the let-off generator 45 in the first embodiment particularly in that the elastic deformer deforms in the front and back direction, not in the right and left direction.

Specifically, the let-off generator 65 has an elastic deformer 67 which is arranged on the transmitter main body 21 of the transmitter 10, and a pressor 68 which is arranged on the hammer arm 30 of the hammer member 11 and elastically deforms the elastic deformer 67 with the pivoting movement of the transmitter 10 and the hammer member 11.

The elastic deformer 67 is arranged on the upper surface of the transmitter main body 21 upward so as to be approximately perpendicular to the inclined upper surface of the transmitter main body 21, at a position slightly back of the interact supporter 22*d* of the upper front edge.

The elastic deformer 67 is formed integrally with an elastic hook 67*a* at its tip (upper edge). The elastic hook 67*a* is a protrusion protruding forward, which the pressor 68 of the hammer member 11 abuts.

The other sections of the elastic deformer 67 are configured similarly to those of the elastic deformer 47 in the first embodiment.

The pressor 68 is formed in a shape such that the position which is slightly back of the interacting attachment 30*c* at the upper front edge and which is right back of the elastic deformer 67 in the initial position protrudes downward, on the hammer arm 30. The lower back edge of the pressor 68 is an abutting part 68*a* which abuts the elastic hook 67*a* of the elastic deformer 67.

The pressor 68 is arranged at a position where it overlaps the elastic deformer 67 in the right and left direction, facing each other with the elastic deformer 67 in the initial state.

The pressor 68 is configured such that the abutting part 68*a* abuts the elastic hook 67*a* and elastically deforms the elastic deformer 67 when the transmitter 10 pivots on the transmitter holding axis 20 and the hammer member 11 pivots on the hammer holding axis 27.

That is, the pressor 68 is configured to elastically deform the elastic deformer 67 backward and causes the elastic hook 67*a* to get over the abutting part 68*a*, when the transmitter 10 and the hammer member 11 pivot and the abutting part 68*a* abuts the lower edge of the elastic hook 67*a*.

In such way, the let-off generator 65 may function similarly to the let-off generator 45 in the first embodiment.

Therefore, according to the third embodiment described hereinbefore, the effect similar to that of the first embodiment can be obtained.

As shown in FIG. 10B, the elastic deformer 67 and the pressor 68 may be arranged vice versa. That is, the elastic deformer 67 may be arranged at the bottom surface of the hammer arm 30 and the pressor 68 on the upper surface of the transmitter main body 21, where the elastic deformer 67 and the pressor 68 face each other in the front and back direction.

The effect similar to that of the first embodiment can be obtained with such configuration.

Fourth Embodiment

Hereinafter the fourth embodiment of the keyboard device in accordance with the present embodiment is explained with reference to FIGS. 11A and 11B.

The fourth embodiment differs from the first embodiment in configuration of a let-off generator. Therefore, the following description is focused on the difference from the first embodiment.

Figure 11A:
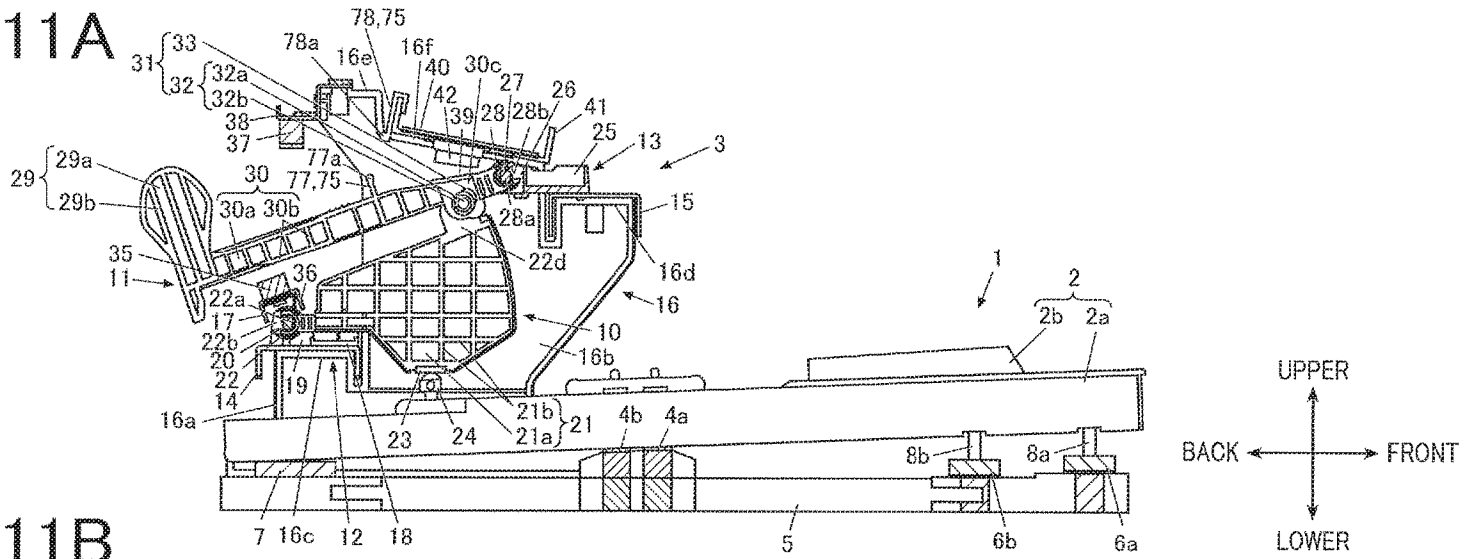
FIG. 11A is a cross-sectional view of the keyboard device in an initial state in accordance with the fourth embodiment.

FIG. 11A is a cross-sectional view of the keyboard device 1 in an initial state in accordance with the fourth embodiment. FIG. 11B is a cross-sectional view of the keyboard device 1 in a state where the key is depressed in accordance with the fourth embodiment.

Figure 11B:
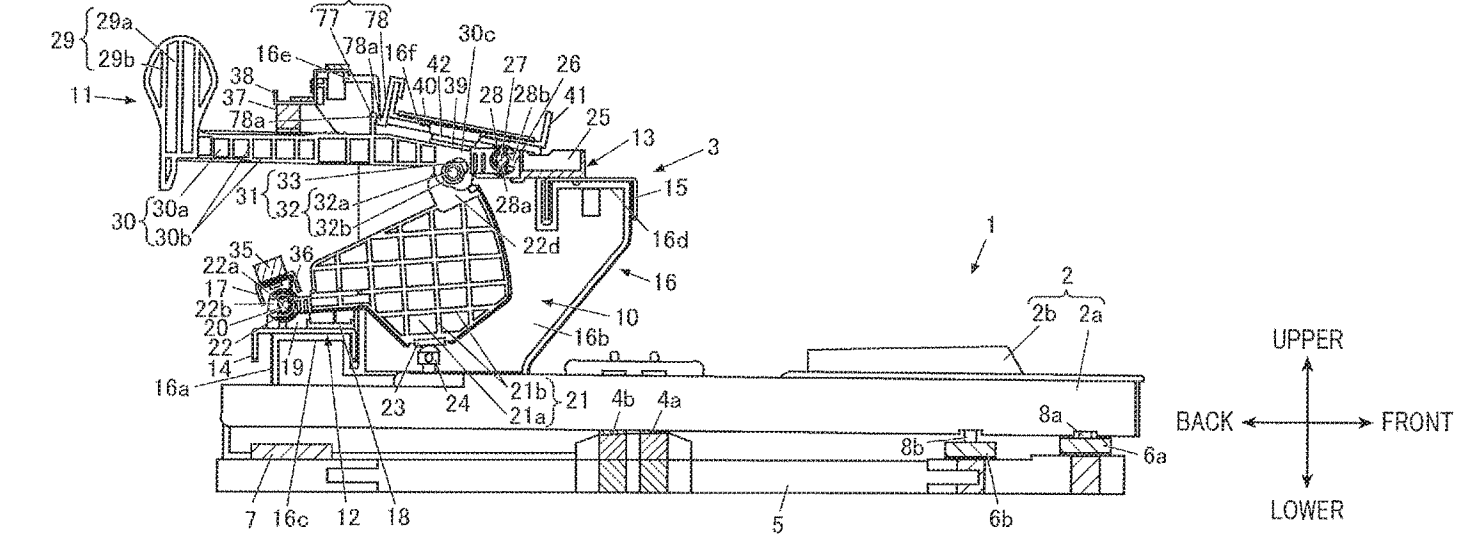
FIG. 11B is a cross-sectional view of the keyboard device in a state where the key is depressed in accordance with the fourth embodiment.

As shown in FIGS. 11A and 11B, the keyboard device 1 in accordance with the present embodiment has a let-off generator 75, instead of the let-off generator 45 in the first embodiment described above.

The let-off generator 75 differs from the let-off generator 45 in the first embodiment particularly in positioning of an elastic deformer and a pressor.

Specifically, the let-off generator 75 has an elastic deformer 77 which is arranged on the hammer arm 30 of the hammer member 11, and a pressor 78 which is arranged on the board supporting rail 41 and elastically deforms the elastic deformer 77 along with the pivoting movement of the transmitter 10 and the hammer member 11.

The elastic deformer 77 is arranged on the upper surface of the hammer arm 30 upward so as to be perpendicular to the inclined upper surface of the hammer member 30, at a position slightly back of the interact attachment 30*c* of the upper front edge.

The elastic deformer 77 is formed integrally with an elastic hook 77*a* at its tip (upper edge). The elastic hook 77*a* is a protrusion protruding forward, which the pressor 78 abuts.

The other sections of the elastic deformer 77 are configured similarly to those of the elastic deformer 47 in the first embodiment.

The pressor 78 is attached to the back edge of the board supporting rail 41. An abutting part 78*a* in a shape of a hook protruding backward is arranged at the lower edge of the pressor 78.

The pressor 78 is configured such that the abutting part 78*a* abuts the elastic hook 77*a* and elastically deforms the elastic deformer 77 when the transmitter 10 pivots on the transmitter holding axis 20 and the hammer member 11 pivots on the hammer holding axis 27.

That is, the pressor 78 is configured to elastically deform the elastic deformer 77 backward and causes the elastic hook 77*a* to get over the abutting part 78*a*, when the transmitter 10 and the hammer member 11 pivot and the abutting part 78*a* abuts the upper edge of the elastic hook 77*a*.

In such way, the let-off generator 75 may function similarly to the let-off generator 45 in the first embodiment.

Therefore, according to the fourth embodiment described hereinbefore, the effect similar to that of the first embodiment can be obtained.

In the first to fourth embodiments described above, the elastic deformer is formed integrally with the transmitter 10 or the hammer member 11. However, the elastic deformer may be separate (separate component) from the transmitter 10 or the hammer member 11.

Figure 12A:
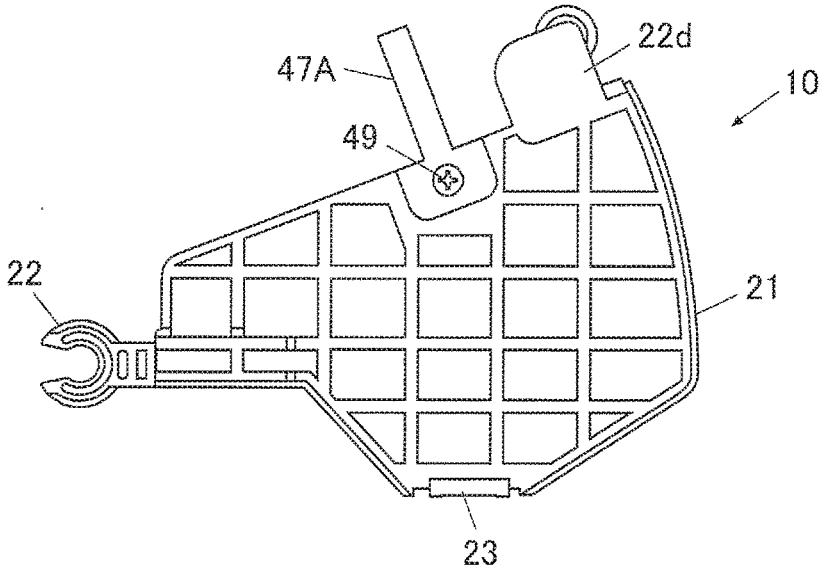
FIG. 12A is a drawing showing a modification example of an elastic deformation part which is separate from the transmitter.
Figure 12B:
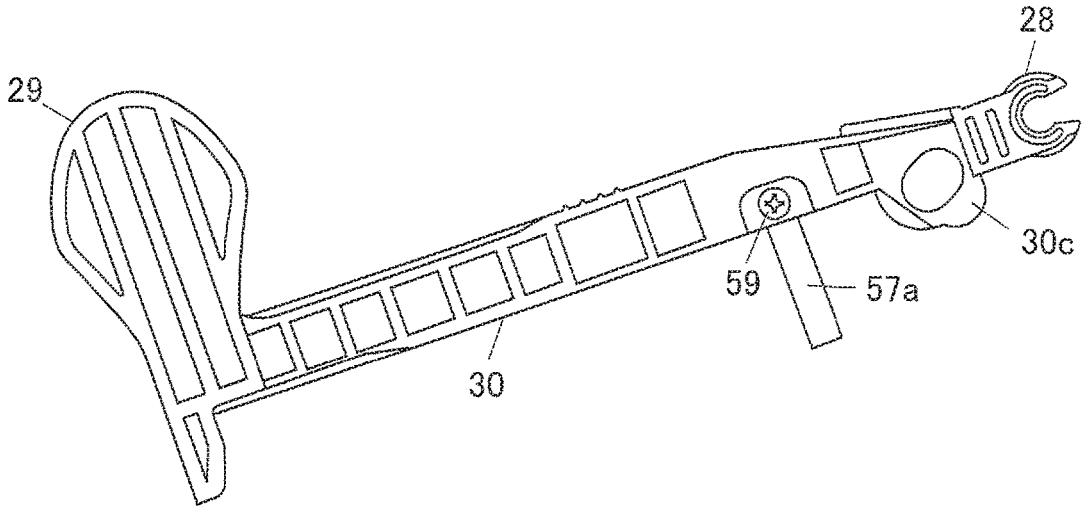
FIG. 12B is a drawing showing a modification example of the elastic deformation part which is separate from the hammer member.

Specifically, as shown in FIG. 12A, the elastic deformer 47 in the first embodiment may be an elastic deformer 47A which is attachable onto the lateral face of the transmitter main body 21 with a screw 49. Otherwise, as shown in FIG. 12B, the elastic deformer 57 in the second embodiment may be an elastic deformer 57*a* which is attachable onto the lateral face of the hammer arm 30 with a screw 59. The elastic deformer may be fixed not only with screws but also by press-fitting, by welding, by glueing, or with double-stick tape. However, it is preferable that the elastic deformer is removably fixed.

With such configurations, it is possible to select a material of the elastic deformer which is appropriate for generating a let-off feeling, irrespective of the material of the transmitter 10 or the hammer member 11. The material of the elastic deformer may be rubber, elastomers, plastic, metals, or such.

Maintainability may be improved as the elastic deformer is easily individually replaceable in a case the elastic deformer deteriorates due to repetitive use.

Specific embodiments of the present invention were described above, but the present invention is not limited to the above embodiments, and modifications, improvements, and the like within the scope of the aims of the present invention are included in the present invention.

It will be apparent to those skilled in the art that various modification and variations can be made in the present invention without departing from the spirit or scope of the invention.

Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A keyboard device comprising:

at least one key; and an action mechanism corresponding to the at least one key, wherein the action mechanism comprises:

a transmitter which moves in response to key depression to the at least one key;

a hammer member which operates, in response to movement of the transmitter, to apply a load to the depressed key;

a first abutting part which is arranged on one of the hammer member and a member which the hammer member abuts; and an elastic part which is arranged on another of the hammer member and the member which the hammer member abuts, wherein at least one part of the elastic part gets over the first abutting part in a process of deforming of the elastic part, thereby a let-off feeling is given to the depressed key.

2. The keyboard device according to claim 1, wherein, by abutting the first abutting part, the elastic deformer elastically deforms in a direction perpendicular to a direction in which the hammer member moves.

3. The keyboard device according to claim 1, wherein the elastic deformer abuts at least one lateral face of the first abutting part.

4. The keyboard device according to claim 1, wherein the transmitter is supported by a transmitter holder, the transmitter being pivotable on a first pivoting axis, and wherein the hammer member is supported by a hammer holder, the hammer member being pivotable on a second pivoting axis.

5. The keyboard device according to claim 1, wherein the elastic deformer is formed integrally with the transmitter.

6. The keyboard device according to claim 1, wherein the elastic deformer is formed separately from the transmitter.

7. The keyboard device according to claim 1, wherein the elastic deformer comprises a second abutting part at a tip of the elastic deformer, the second abutting part abutting the first abutting part, and wherein the second abutting part comprises at least one of an R corner or a chemfered corner at both edges in a direction in which the hammer member moves.

8. The keyboard device according to claim 1, wherein the elastic deformer and the first abutting part are each arranged at a position where a distance between the transmitter and the hammer member widens in response to the key depression, wherein the elastic deformer and the first abutting part do not abut each other while a distance between the transmitter and the hammer member is within a first distance, and wherein the elastic deformer and the first abutting part abut each other while the distance between the transmitter and the hammer member is equal to the first distance.

9. The keyboard device according to claim 8:

wherein counter force is given against a direction of widening the distance between the transmitter and the hammer member when the distance between the transmitter and the hammer member is equal to the first distance in response to the key depression and the elastic deformer elastically deforms by abutting the first abutting part, and wherein counter force is not given against a direction of narrowing the distance between the transmitter and the hammer member when the distance between the transmitter and the hammer member is back to within the first distance in response to key release and the elastic deformer elastically deforms by separating from the first abutting part.

10. A keyboard device comprising:

at least one key; and an action mechanism corresponding to the at least one key, wherein the action mechanism comprises:

a transmitter which moves in response to key depression to the at least key; and a hammer member which adds weight to the depressed key by moving in response to the transmitter and on which an elastic deformer is arranged, wherein a let-off feeling is given to the depressed key when a first abutting part which abuts the elastic deformer causes the elastic deformer to elastically deform.

11. The keyboard device according to claim 10, wherein, by abutting the first abutting part, the elastic deformer elastically deforms in a direction perpendicular to a direction in which the hammer member moves.

12. The keyboard device according to claim 10, wherein the elastic deformer abuts at least one lateral face of the first abutting part.

13. The keyboard device according to claim 10, wherein the transmitter is supported by a transmitter holder, the transmitter being pivotable on a first pivoting axis, and wherein the hammer member is supported by a hammer holder, the hammer member being pivotable on a second pivoting axis.

14. The keyboard device according to claim 10, wherein the elastic deformer is formed integrally with the hammer member.

15. The keyboard device according to claim 10, wherein the elastic deformer is formed separately from the hammer member.

16. The keyboard device according to claim 10, wherein the elastic deformer comprises a second abutting part at a tip of the elastic deformer, the second abutting part abutting the first abutting part, and wherein the second abutting part comprises at least one of an R corner or a chemfered corner at both edges in a direction in which the hammer member moves.

17. The keyboard device according to claim 10, wherein the elastic deformer and the first abutting part are each arranged at a position where a distance between the transmitter and the hammer member widens in response to the key depression, wherein the elastic deformer and the first abutting part do not abut each other while a distance between the transmitter and the hammer member is within a first distance, and wherein the elastic deformer and the first abutting part abut each other while the distance between the transmitter and the hammer member is over the first distance.

18. The keyboard device according to claim 10, wherein counter force is given against a direction of widening the distance between the transmitter and the hammer member when the distance between the transmitter and the hammer member is equal to the first distance in response to the key depression and the elastic deformer elastically deforms by abutting the first abutting part, and wherein counter force is not given against a direction of narrowing the distance between the transmitter and the hammer member when the distance between the transmitter and the hammer member is back to within the first distance in response to key release and the elastic deformer elastically deforms by separating from the first abutting part.

* * * * *